United States Patent [19]

Gourmel et al.

[11] Patent Number: 4,611,651

[45] Date of Patent: Sep. 16, 1986

[54] METHOD AND APPARATUS FOR CONTINUOUS CASTING OF METAL PIPE WITH INTEGRAL END FITTING

[75] Inventors: Yves Gourmel; Michel Pierrel; Rio Bellocci, all of Pont-A-Mousson, France

[73] Assignee: Pont-A-Mousson S.A., Nancy, France

[21] Appl. No.: 630,043

[22] Filed: Jul. 12, 1984

[30] Foreign Application Priority Data

Jul. 12, 1983 [FR] France ..... 83 11788

[51] Int. Cl.[4] ..... B22D 11/00

[52] U.S. Cl. ..... 164/464; 164/421; 164/474; 164/483; 164/465

[58] Field of Search ..... 164/63, 254, 255, 256, 164/257, 421, 422, 464, 465, 474, 483, 425, 445

[56] References Cited

U.S. PATENT DOCUMENTS

| | | | |
|---|---|---|---|
| 3,287,773 | 11/1966 | Woodburn et al. | 164/464 |
| 3,872,913 | 3/1975 | Lohikoski | 164/421 |
| 4,146,079 | 3/1979 | Anisovich et al. | 164/421 |

FOREIGN PATENT DOCUMENTS

| | | | |
|---|---|---|---|
| 804840 | 3/1951 | Fed. Rep. of Germany . | |
| 45-39344 | 12/1970 | Japan | 164/465 |
| 57-85656 | 5/1982 | Japan | 164/464 |
| 275326 | 7/1970 | U.S.S.R. | 164/464 |

*Primary Examiner*—Nicholas P. Godici
*Assistant Examiner*—Richard K. Seidel
*Attorney, Agent, or Firm*—Sughrue, Mion, Zinn, Macpeak and Seas

[57] ABSTRACT

The vertically ascending casting of a thin-walled metal pipe and integral end fitting from a bath of molten metal is implemented using a housing 12 and a core 14 to mold the end fitting or bell housing and a tubular draw tube 6 to mold the pipe shank. The end fitting E is first formed by forcing the metal to rise in the annular space 16 between the housing and the core, simultaneously forming the initial section of the pipe shank. Once the end fitting has solidified it is extracted upwardly, step by step, while shank sections are simultaneously withdrawn from the metal bath. These sections are also solidified step by step along a tapering front S in the bath until the desired length of pipe T has been obtained.

17 Claims, 10 Drawing Figures

24
5
4
N
Y
Y
13
12
6a
8
11
2
19
18
6
7
23
f
X
14
N
3
X
22
17
16
15
1
20
21
14a
9
10

24
5
4
Y
Y
13
14a
12
6a
8
11
2
19
18
1
6
S
22
14
17
7

Fig. 3
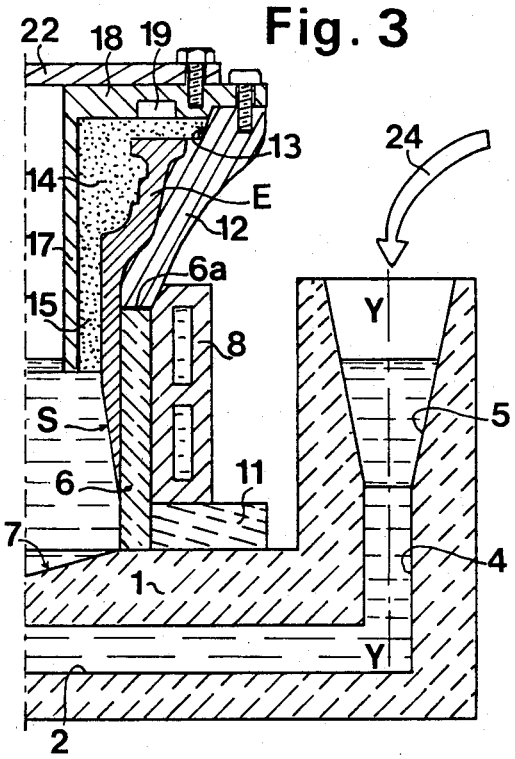
Fig. 5
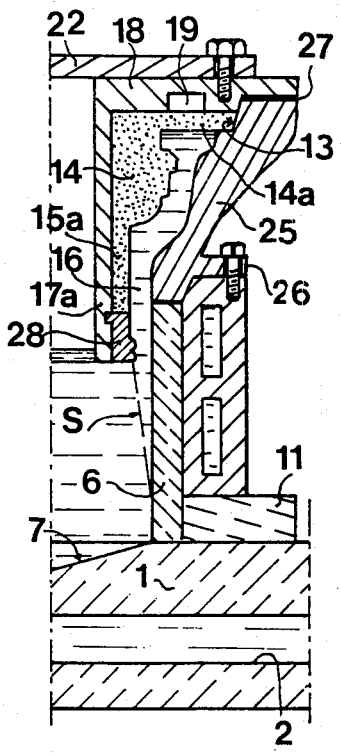
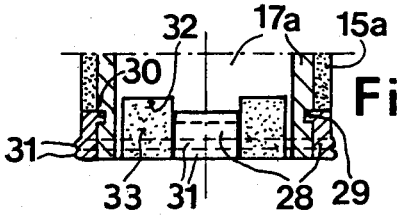
Fig. 7
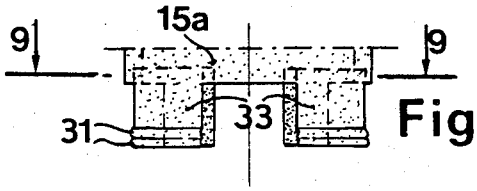
Fig. 8
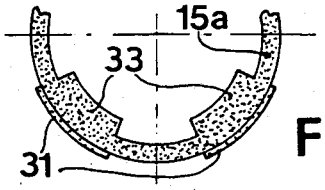
Fig. 9
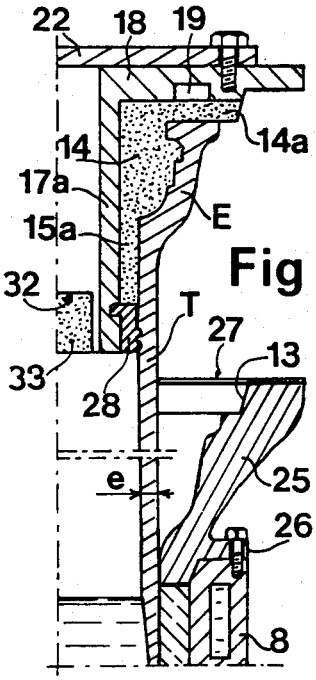
Fig. 6

METHOD AND APPARATUS FOR CONTINUOUS CASTING OF METAL PIPE WITH INTEGRAL END FITTING

BACKGROUND OF THE INVENTION

This invention relates to the continuous vertical casting of a metal pipe equipped with an end fitting. Although the invention is applicable to pipes of any thickness, it is particularly well adapted to the manufacture of thin-walled pipes displaying a low thickness to diameter ratio of less than 10%. The wall thickness may vary, as a function of the pipe diameter, from less than 5 mm (80 mm diameter) to less than 15 mm (1,000 mm diameter).

German Pat. No. 804,840 teaches the continuous ascending casting of a metal tube having a small diameter and very thick walls, which is gradually extracted from a bath of molten metal as it solidifies inside a short, vertically positioned draw tube, the bottom end of which communicates with the metal bath. This process does not provide for casting a tube having an integral end fitting.

SUMMARY OF THE INVENTION

Applicants have addressed the problem of producing a pipe with an end fitting by continuous, ascending casting, without using a core or mandrel to form the internal cylindrical cavity of the tubular portion of the pipe, and have resolved such problem by the method and apparatus of the invention.

The bottom loading process is of the type employing a core to provide the internal shape of the end fitting and a crucible-reservoir of molten metal, having a cylindrical wall, to form a draw tube to provide the shape of the pipe shank adjacent to the fitting. The draw tube is cooled externally, and the end fitting and the initial section of the shank are first formed by forcing the molten metal to rise in the annular space between a housing which molds the exterior shape of the fitting and the core. Once the end fitting has solidified it is vertically extracted step by step to withdraw from the crucible and the metal bath a short section of a solidified tubular body having an outside diameter which corresponds to the diameter of the cooled cylindrical draw tube and an interior diameter which corresponds to the diameter created by the core of the fitting. Without interrupting the supply of molten metal, the ascents of the end fitting and the short pauses for solidification are alternated to form the shank of the pipe in short, successive tubular sections, without a core, by simple centripetal cooling. Once the pipe has reached a sufficient length, the supply of molten metal is cut off and the crucible is drained.

The apparatus for implementing this process comprises a crucible formed of a tubular draw tube and having a bottom made of a refractory material containing a supply conduit for molten metal. The tubular draw tube is topped by a steel housing to mold the exterior shape of the end fitting, and carries a core for the fitting made of a porous, gas-permeable refractory material to mold the interior shape of the fitting and form the beginning of the cylindrical cavity of the shank of the pipe. The upper portions of the housing and core are flared outwardly, along the same axis as the graphite draw tube, and the core has a tubular apron whose lower end is immersed to a depth corresponding to part of the height of the draw tube and to an initial section of the pipe shank.

Through this process and apparatus a cast metal pipe with an integral end fitting may be produced in a simple and therefore reliable and inexpensive manner, with a low ratio of thickness to diameter and displaying not only excellent exterior surface characteristics, which are conventionally produced by tubular draw tubes, but also excellent interior surface characteristics despite the absence of a mandrel or core.

In one embodiment of the invention the melt is aspirated to form the fitting and is bottom loaded through a siphon assembly. In another embodiment the melt is bottom loaded at low gas pressure, and is not aspirated.

BRIEF DESCRIPTION OF THE DRAWINGS

FIG. 3 is a partial cross-sectional view, similar to FIG. 2, showing the solidification phase of the end fitting and the formation of the initial section of a shank;

FIG. 5 is a partial cross-sectional view similar to FIG. 2, of an alternate embodiment using internal means of extraction at the end of the core;

FIG. 6 is a partial cross-sectional view showing the extraction of a pipe during the forming process using the internal means;

FIG. 7 is a detailed cross-sectional view showing the internal means for extracting the core of the fitting;

FIG. 8 is a partial detailed cross-sectional view, similar to FIG. 7, of the end of the core, modified to accommodate the internal extraction means;

FIG. 9 is a partial detailed cross-sectional view along line 9—9 of FIG. 8.

DETAILED DESCRIPTION OF THE PREFERRED EMBODIMENTS

Figure 1:
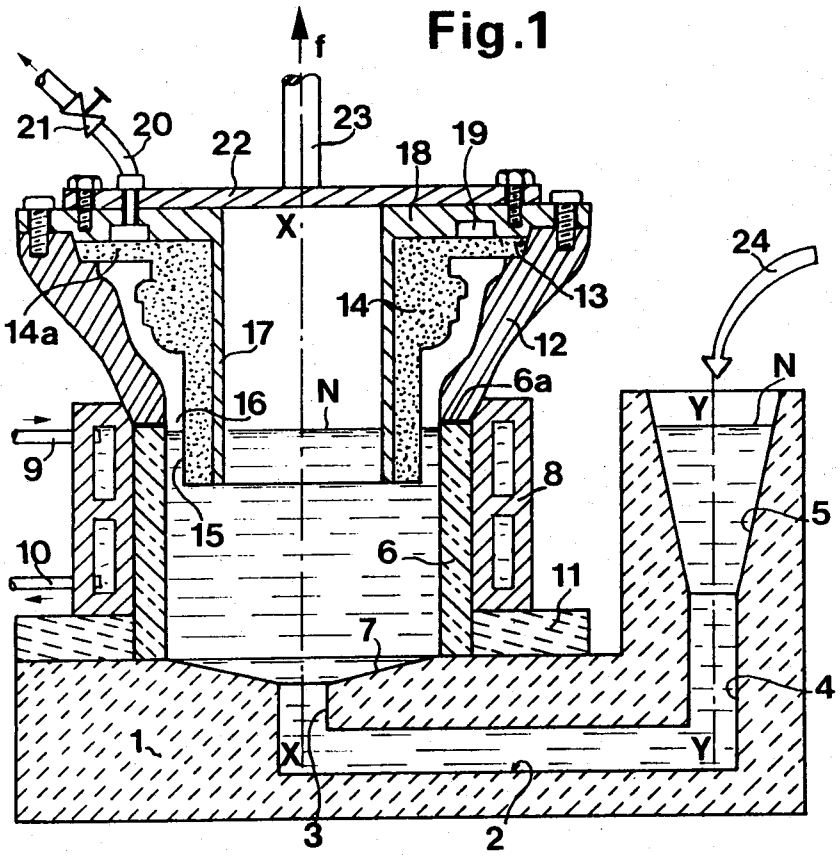
FIG. 1 is a schematic cross-sectional view of an apparatus according to the invention, at the time when casting is about to begin.

In FIG. 1 the invention is applied to the continuous, ascending casting of a metal pipe T, equipped with an end fitting. The pipe is thin-walled due to a low ratio of thickness to diameter of less than 10%; the thickness of the tubular shank adjacent the end fitting does not exceed 15 mm for a 1,000 mm diameter, 8 mm for a 300 mm diameter and 5 mm for an 80 mm diameter.

The apparatus comprises a source of molten metal fed through a siphon assembly, a crucible formed of a cooled, tubular draw tube, a housing and a core for the end fitting, mechanisms for aspirating the molten metal, and an extractor for the shaped pipe.

SUPPLY OF MOLTEN METAL FED THROUGH A SIPHON ASSEMBLY

A hollow base 1 made of a refractory material, for example an aluminosilicate, comprises an interior L-shaped casting conduit with a horizontal or slightly inclined leg 2 and a vertical foot 3 along the XX axis for the bottom loading of the crucible. A vertical chimney 4 rises from the base 1 along the YY axis, which runs parallel to the XX axis of the foot 3. The lower end of the chimney is connected to the leg of the casting conduit, and the chimney is topped by a casting funnel 5. The height of the chimney is equal to the height of a crucible draw tube 6. Parts 1 through 5 form a siphon assembly. The melt supply is bottom-loaded, i.e. fed from the lower part of the draw tube 6.

THE EXTERNALLY COOLED CRUCIBLE

Along the XX axis above the foot 3, the base 1 supports a crucible comprising a tubular graphite draw tube 6 forming a vat bottom 7 in the shape of a conical frustum, which is slightly flared near the foot of the casting conduit. The vat bottom is not cooled.

The draw tube 6 is externally cooled by a copper jacket 8. Cool water flows in through a conduit 9 and flows out through another conduit 10. The jacket 8 is in contact with and surrounds the draw tube 6 along most of its length, except for the bottom part which is protected from cooling by an annular bearing plate 11 made of a refractory and therefore thermally insulating material, such as aluminosilicate.

SHELL & CORE

The draw tube 6 is topped by an annular steel housing 12 which is flared toward the top, and whose cavity molds the exterior shape of the end fitting to be produced. At its bottom end the housing 12 has the same thickness and the same interior and exterior diameters as the draw tube to form an unbroken continuation thereof. The bottom part of the housing 12 fits within the top part of the cooling jacket 8 for purposes of assembly. To ensure an air-tight seal a bead of sealant **6*a* is placed between the draw tube and the housing. The bead may be formed by a poured layer of epoxy resin. In this example the outside of the housing 12** is cooled only by ambient air, but it may also be cooled with water spray nozzles (not shown).

Above the mold cavity proper, the housing 12 has an extended bearing surface in the shape of a conical frustum 13 for receiving the flange of an annular end fitting core 14 made of a porous sand mixture, for example a hardened mixture of sand and thermosetting resin. The core 14 molds the interior shape of the end fitting, and comprises a tubular apron 15 whose outside wall corresponds to the inside wall of the pipe T to be produced. The length of the core 14 is greater than that of the housing 12 so that the apron 15 extends below the housing and into the upper part of the draw tube 6. Thus, the apron 15 together with the draw tube define an annular space 16 which corresponds to the thickness of the pipe to be formed. The sand core 14 has a tubular steel core center 17 which is air-tight and capable of withstanding the temperature of the molten metal.

ASPIRATION MECHANISM

The core 14 is held in bearing 13 of the housing by a circular metal suction plate 18 having an annular suction groove 19 which opens toward the flange of the core. A conduit 20 which is connected through a valve 21 to a source of suction (not shown) emerges into the groove 19. The suction plate is bolted to the housing 12.

THE EXTRACTOR

The extractor is represented in a partial schematic form as a circular metal lift plate 22, bolted to the suction plate 18, and a lifting rod 23 which is suspended from a lifting device which operates vertically (not shown). A vent (not shown) may also be provided in the plate 22 to avoid trapping air within the core cavity.

OPERATION

SUPPLY OF MOLTEN METAL (FIG. 1)

After assembling the housing 12, the core 13, the suction plate 18 and the lift plate 22 on top of the graphite draw tube 6, melt is loaded into the casting funnel 5 as shown by arrow 24. The valve 21 of the suction conduit 20 is closed. The base 1 and crucible formed by the draw tube is filled to the level N corresponding to the top part of the cooling jacket 8 through which water circulates. Because of the principle of communicating vessels, the level N is the same in the draw tube and the funnel. The apron 15 of the core and its tubular steel core center 17 are immersed in the molten metal to a depth such that, during the subsequent phase of molding the end fitting, the air trapped inside the core center cannot be aspirated by the conduit 20.

Figure 2:
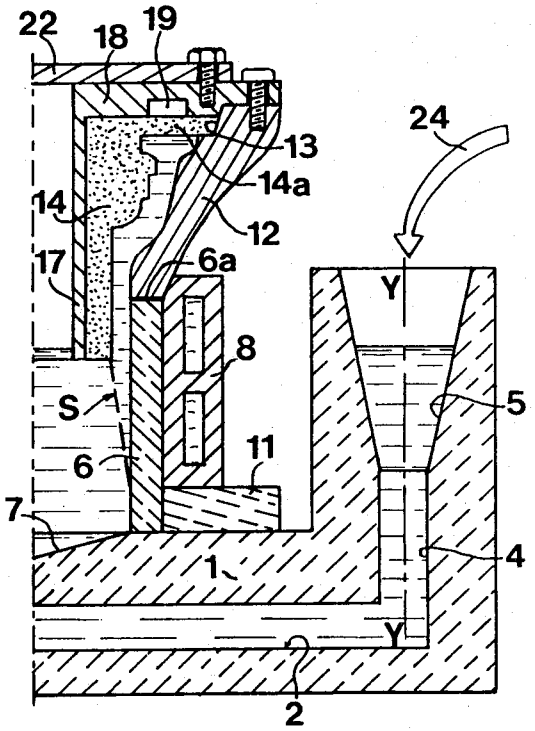
FIG. 2 is a partial cross-sectional view, similar to FIG. 1, showing the casting phase of the end fitting.

MOLDING THE END FITTING (FIGS. 1 and 2)

When the housing 12 forms an air-tight connection with the top of the draw tube 6, the suction valve 21 is opened and the air in the annular space 16 is aspirated through the suction conduit 20, the circular groove 19, and the porous flange **14*a* of the core. Because of the impermeable steel core center 17, no suction is produced in the tubular cavity inside the core. This aspiration restriction is also produced by the immersion of the apron 15** and the core center below the level N of the molten metal.

The molten metal rises rapidly into the annular space 16, which it fills up to the porous core flange **14*a*. The end fitting is molded almost instantaneously (it occurs in less than one second). Correlatively, because the molten metal contained in the interior cavity of the draw tube is drawn out, the level sinks in the space inside the core center and in the funnel 5. However, the level of melt does not sink below the core center and the apron 15**, which remain immersed and form a hydraulic, air-tight seal. The end fitting begins to solidify from the top.

DISCONTINUOUS EXTRACTION OF A TUBE (T)

Figure 4:
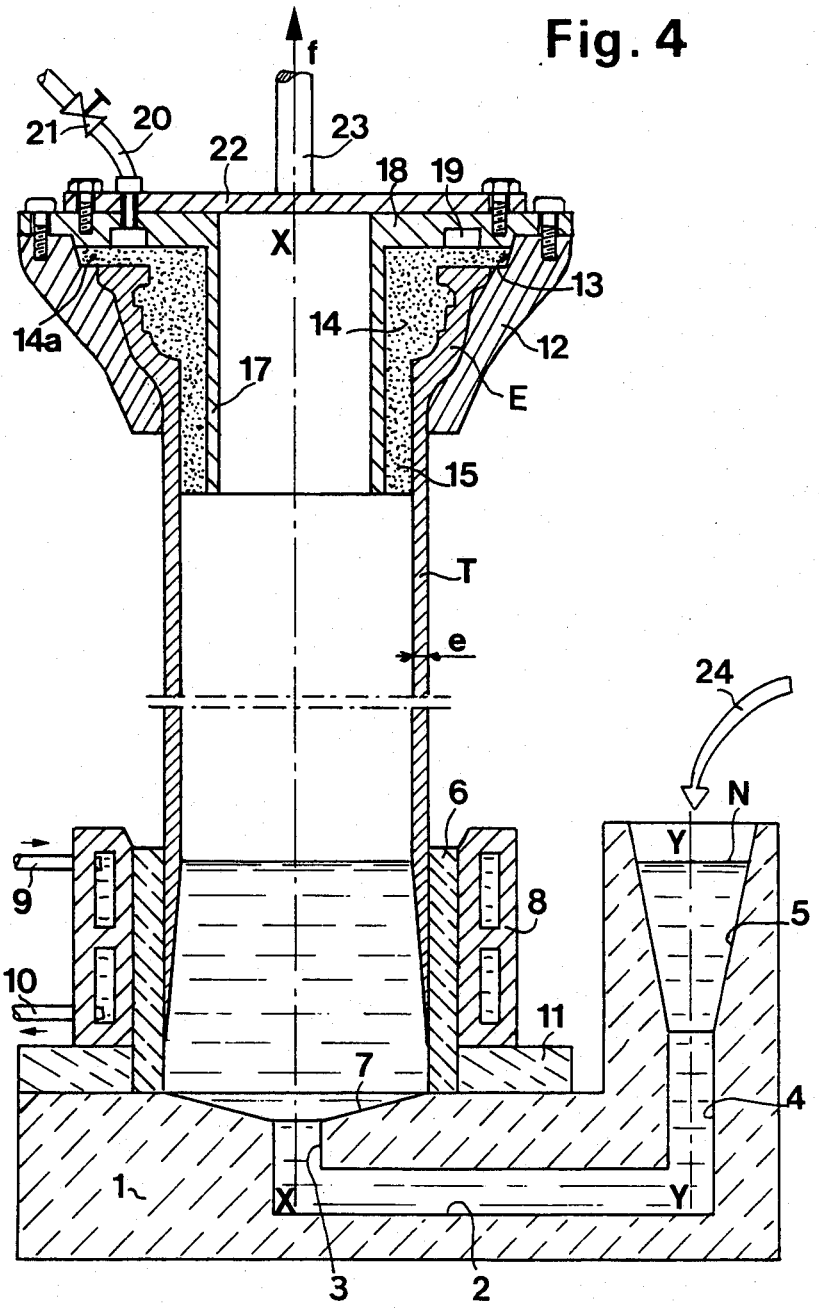
FIG. 4 is a schematic cross-sectional view similar to FIG. 1, showing the continuous, ascending casting of the pipe by extracting the solidified end fitting with a continuous supply of bottom-loaded molten metal.

In order to begin extraction, the level of molten metal, which has sunk, is restored by loading melt into the funnel 5 during the time when the end fitting is solidifying, whereafter the suction valve 21 is closed. The molten metal in the annular space between the apron 15 and the top of the draw tube 6 and the bottom of the housing 12 is cooled both by the top part of the cooling jacket 8 and the housing 12. This cooling effect produces solidification along a front S in the approximate shape of a conical frustum, beginning at the wall of the draw tube 6 at the height of the bottom end of the cooling jacket 8 and converging toward the vertical XX axis up to the bottom end of the apron 15 of the core. At this stage of solidification along the front S, the extractor assembly formed of the lift plate 22 and the housing 12 is activated in an ascending direction (arrow f in FIG. 4) while more molten metal is poured into the funnel to replace that extracted from the crucible. In this manner, during the extraction process the level N is constantly maintained slightly below the top of the draw tube 6-a level at which the melt will still be cooled by the jacket 8. The ascending extraction of the solidified end fitting E together with the housing, the suction plate, the lift plate and the core is performed in a discontinuous fashion, step by step. It must be noted that an initial section of pipe shank is formed at the same time as the end fitting E in the annular space 16 between the apron 15 and the housing. This initial shank section becomes thinner, approximately following front S, until it reaches the lower end of the cooling jacket 8 (FIGS. 3 and 4).

The initial ascent distance of the end fitting, housing and core represents only a fraction of the height of the molten metal which is in the process of solidifying below the initial shank section. It measures, for example, from one to several centimeters. The initial shank section thus lengthens by a few centimeters of solidified melt extracted from the crucible. The first, short ascending cycle is followed by a cooling and solidification period for the molten metal which has risen to the top part of the draw tube, which occurs under the same conditions as described previously and is followed by a second ascending cycle of the same magnitude as the first. Periods of ascent of the same magnitude and of cooling for the same time follow each other in succession, while the tube T that is being produced continues to be "fed" by additions of molten metal through the funnel. Shortly after the end of the first cycle, the extracted assembly is at a sufficient distance from the crucible so that the core apron 15 is no longer immersed in the molten metal. The result is that the molten metal which is in the solidification process is that which, at level N, is externally cooled by the jacket 8. The solidification front S extends down to the lower end of the cooling jacket, where the quantity of solidified melt is zero.

The step by step lifting or ascending extraction process is continued to pull up a new short tubular section which follows the adjacent solid portion of pipe. These ascents are interrupted by solidification periods. The outside wall of the pipe formed in this manner adopts the shape of the inside wall of the draw tube 6. The inside wall of the pipe no longer comes into contact with any wall since the core is no longer present. Simultaneously, the molten metal is bottom loaded by pouring in melt to compensate for the melt removal at the top part of the crucible and to maintain a constant level N below the top of the draw tube, at a height where it is exposed to the effect of the cooling jacket in order to form uniform shank sections or increments. When the pipe shank has reached the desired length the melt in the crucible is rapidly drained through a slide valve opening (not shown) below the foot 3 of the casting conduit.

The pipe is then lifted to a sufficient height so that its lower end can be withdrawn from the draw tube 6. After the rapid melt drainage, the pipe is cut at the bottom to provide a specific length with a uniform or possibly a shaped lower end.

The housing 12 and the core 14 are detached from the suction plate 18 and the pipe T is removed. To release the end fitting E the housing is removed by sliding it along and off of the shank of the pipe T; the sand core 14 is broken and the steel core center 17 is retrieved.

Another housing 12 equipped with a new core 14 is then attached under the suction plate 18, and the new assembly is repositioned on the top of the draw tube 6 as shown in FIG. 1.

In summary, the process according to the invention consists of causing the molten metal to rise by aspiration in an annular space 16 between the housing 12 and the core 14 which mold the shape of the end fitting and an initial shank section of thickness e from a reservoir of molten metal loaded from the bottom, to cause the molten metal to solidify starting from the top in this annular space and along a membrane or skin which is in contact with the cooled wall of the reservoir, wherein the membrane has a thickness which decreases toward the bottom from a maximum value of e, to allow the membrane to thicken over time by solidification up to the value e, and to extract this solid membrane step by step in an ascending motion, and by continuously supplying the crucible with molten metal.

ADVANTAGES

The upward aspiration coupled with the ascending supply of molten metal to form the end fitting results in filling both by aspiration and by pressure in the annular space 16 between the housing and the porous core; the space is completely filled and no air pockets or gas bubbles are trapped in the space.

Because the porous core 14 is permeable to air and because the core apron 15 is immersed in the molten metal and the tubular steel core center 17 is air-tight, the aspiration is restricted to the annular space between the housing and the core.

Because the molten metal is bottom loaded through the system of communicating vessels formed of the draw tube crucible and the casting conduit, only pure molten metal free of foreign bodies or particles, is drawn upward to form the pipe T, while impurities float on the exposed surface of the casting funnel 5.

Because of the combination of the housing 12 and the draw tube 6 for the exterior wall, on the one hand, and of the core 14 with its long apron 15 for the interior wall, the initial section of pipe shank produced adjacent the end fitting displays excellent surface characteristics and therefore produces a very clean joint between the end fitting and the shank.

These excellent surface characteristics are produced not only on the exterior when the core 14 is drawn away from the draw tube 6 (FIG. 4), but also on the interior despite the absence of the core because the temperature of the lower end of the draw tube, which is not cooled, is maintained at the point of contact of the molten metal and the plate 11 by the regular, short ascending motions interrupted by regular cooling periods which maintain uniform conditions for shaping solidified, annular shank sections at the top of the draw tube, and because of the uniform solidification temperature conditions.

VARIATIONS

To eliminate the need to slide the housing 12 off of the pipe shank after molding, the housing 12 can be left in place on the draw tube during the extraction process (FIGS. 5, 6 and 7), with internal mechanisms being provided for gripping and extracting the pipe tube being produced. For this purpose a housing 25 is provided, similar to housing 12 but displaying the following modifications: at its bottom part, where its diameter is the smallest, it comprises a flange 26 which is designed to be bolted to the top of the cooling jacket 8. In addition, instead of being attached at the top to the suction plate 18, the housing 25 carries a bead of mastic, silicone or an epoxy resin sealant 27 on its uppermost edge to provide an air-tight seal between the plate and the housing without preventing the detachment or separation of the plate 18 during extraction.

To implement the internal gripping of the end fitting the core is equipped with an apron 15*a* which is modified in the following manner: the bottom edge of the apron is grooved at regular intervals around its periphery, and these grooves are filled to the point where they are flush with the bottom surface of the core center 17*a* by sections of metal ferrules 28 in the form of cylindrical sectors, in a quantity of four to six, for example. These ferrule sections 28 form internal locks and, on their internal surface which is in contact with the core center a protruding circular rib 29 is engaged but not locked into a circular extended neck 30 of the core center; the ribs 29 are thus disposed near the core apron 15*a*. The ferrule sections 28 comprise, on their exterior surface, which extends to the point where it is flush with the convex exterior wall of the apron 15*a*, a gripping edge 31 in the form of a pair of raised circular ridge sections 31.

The metal core center 17*a* has notches 32 at regular intervals around its periphery, which are filled by complementary splines of sand 33 which are part of the core apron 15*a*. Each sand spline 33 has a center angle which is at least equal to that of the ferrule sections 28. The sand splines are equal in number to the ferrule sections and are also equipped with gripping edges 31 of a shape identical to that of the ridges on the ferrule sections to thus form a pair of completely circular ridges.

The shaping of the pipe T and end fitting E is similar to that defined in the previous example. The difference in the operation lies in the movement of the pipe while it is being produced during extraction and in the unmolding process: as soon as the suction plate 18 is lifted via the rod 23 (not shown in FIG. 6) and vented plate 22, it moves away from the housing 25 which remains affixed to the cooling jacket 8 by its flange 26, and pulls up the end fitting by the undercut portion of the core 14 and by the ferrule sections 28 and sand splines 33. At the end of the casting process, to unmold the pipe T it is rotated around the XX axis relative to the annular plate 18 in order to break the core 14 and the splines 33 and to thus fill the empty spaces left by the splines with the ferrule sections 28 which, as soon as traction is exerted on the pipe T relative to the plate 18 retract in centripetal fashion. The pipe T is therefore slidably released from the housing 25 during the extraction process, which avoids the additional step of removing the housing along the formed pipe shank.

Figure 10:
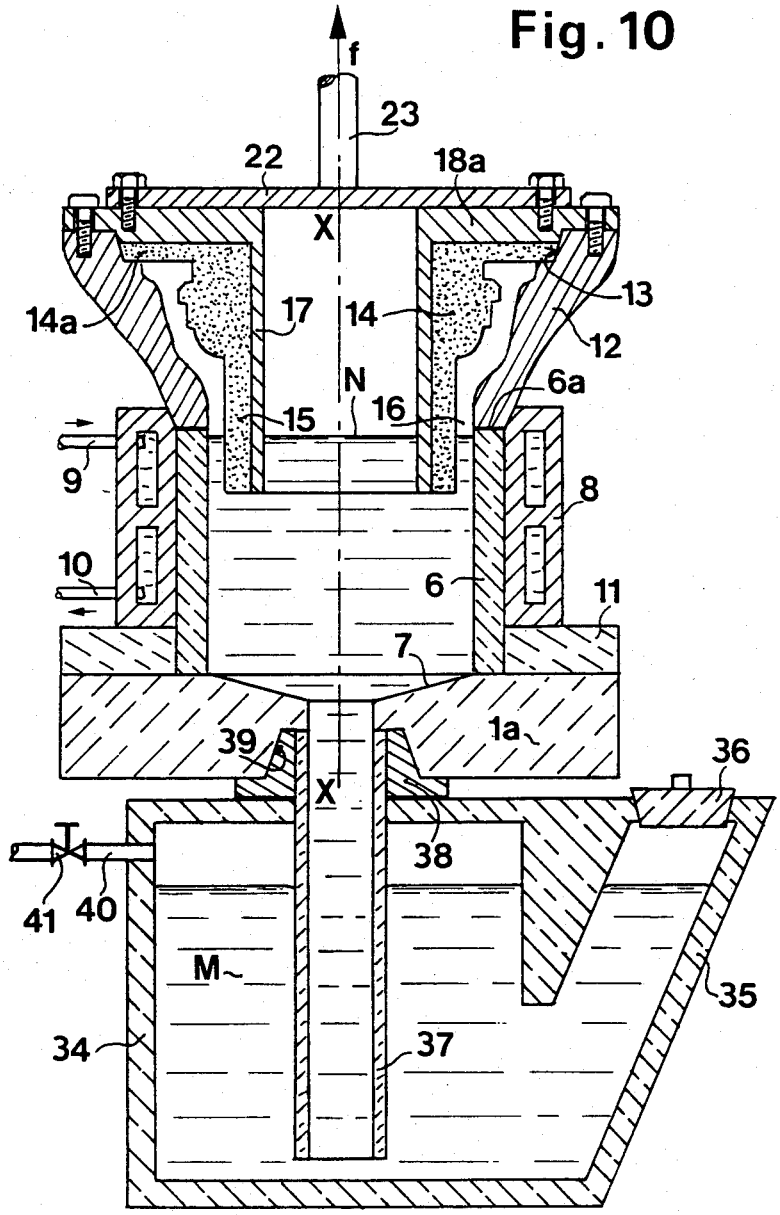
FIG. 10 is a schematic cross-sectional view of an alternate embodiment employing ascending supply at low pressure, without aspiration.

According to another variation (FIG. 10), the siphon assembly is replaced by a pressurized casting pocket 34 of the steam kettle type, with a slanted filler neck closed by a lid 36. A vertical casting tube 37 made of a refractory material passes through the top wall of the closed pocket. It extends almost to the bottom of the pocket and protrudes over the top wall a short distance. It is surrounded and reinforced by a connector pipe 38 in the shape of a conical frustum with a matching connector 39 at the bottom of the base 1*a* so that the casting tube 37 communicates with the crucible cavity.

A conduit 40 which communicates with the interior of the pocket 34 at the top thereof, above the level of the molten metal M, is connected through a valve 41 to a source of compressed air or the like. The plate 18*a* is modified by eliminating the suction groove 19 and the conduit 20.

A pipe is formed by the same process as described in the first embodiment, but using a different method of loading molten metal. The annular space 16 is first filled by increasing the pressure in the casting pocket 34 to cause the molten metal to rise in the tube 37, and the pressure is continuously increased while the end fitting E is drawn upward step by step, as in the preceding example. The pressure is released abruptly in the conduit 40 only after the pipe has reached a desired length.

During the initial filling of the space 16, the air within the space escapes through the porous core and the unsealed joint between the housing and the plate 18*a*.

In this variation the housing 12 may also be replaced by the housing 25 and core apron 15*a* as shown in FIGS. 5–9.

In a further variation applicable to the first method of loading the molten metal using a siphon assembly, instead of bottom loading the metal along the XX axis of the draw tube 6, it may be supplied to the crucible bottom 7 tangentially to the draw tube.

Finally, the temperature of the siphon assembly is adjustable and may be controlled by electrically heating the supply conduit 2, 3.

What is claimed is:

1. A process for the continuous, vertically ascending casting of a tubular pipe shank (T) and integral end fitting (E) by bottom loading with molten metal, said process employing a core (14) to mold the interior shape of the end fitting and a cylindrical crucible forming a draw tube (6) to mold the exterior shape of the pipe shank, wherein the draw tube is externally cooled, and wherein the pipe shank is formed by the ascending extraction of solidified metal, step by step, out of the draw tube, characterized by the steps of:

(a) sealingly disposing a housing (12; 25) atop an upper end of the draw tube and surrounding the core to define therebetween an outwardly flared annular space (16) configured as a female bell housing adapted to receive a male pipe end during installation, and (b) before the step by step forming of the pipe shank by ascending extraction, including molten metal in the crucible to rise into and fill said annular space to form the end fitting and an integral initial section of pipe shank, said housing defining the exterior shape of the end fitting.

2. A process as claimed in claim 1, wherein the molten metal is induced to rise by aspirating said annular space.

3. A process as claimed in claim 1, wherein during the process of molding the end fitting, a bottom part of the annular space to be filled with molten metal to form the fitting is sealed by an air-tight hydraulic joint of molten metal.

4. A process as claimed in claim 1, wherein the molten metal is induced to rise by pressurizing a bath of molten metal supplying the crucible.

5. A process as claimed in claim 1, wherein traction is exerted on the solidified end fitting from within the fitting to extract the pipe being produced.

6. An apparatus for the continuous, vertically ascending casting of a tubular pipe shank (T) and integral end fitting (E) by bottom loading with molten metal, comprising: a crucible formed by a tubular draw tube (6) and a base (1) made of a refractory material, a molten metal supply conduit (3) emerging into the draw tube, a steel housing (12) sealingly disposed on top of the draw tube for defining and molding the exterior shape of the end fitting, a core (14) made of a porous, gas-permeable refractory material supported by the housing for defining and molding the interior shape of the end fitting and forming, with the draw tube and housing, an annular cavity (16) for molding the end fitting and an initial section of the pipe shank, and means for inducing molten metal in the crucible to rise into and fill said annular cavity to form the end fitting, wherein said housing and said core are outwardly flared at their upper ends, coaxial to the draw tube, to define therebetween a female bell housing adapted to receive a male pipe end during installation, and wherein said core comprises a downwardly depending tubular apron (15) which is initially immersed in the molten metal at its lower end to a predetermined depth corresponding to a portion of the height of the draw tube to establish an air-tight hydraulic seal.

7. An apparatus as claimed in claim 6, wherein the core apron (15) extends within and faces the housing and the draw tube, and the interior of the core (14) is lined with an air-tight and heat resistant core center (17).

8. An apparatus as claimed in claim 7, wherein the core center is a tubular steel core.

9. An apparatus as claimed in claim 6, wherein the core has a flange (14*a*) for support on and suspension from a bearing surface (13) of the housing (12) and for the passage of aspirated air and gases toward an adjacent annular groove (19) of a suction plate (18) disposed atop the core and housing.

10. An apparatus as claimed in claim 9, further comprising a lift plate (22) mounted to the suction plate and integral with an ascending extractor rod (23).

11. An apparatus as claimed in claim 9, wherein the housing (25) is fixedly mounted to the draw tube but separably mounted to the suction plate, and the core comprises internal means (28, 31, 33) for gripping and extracting the solidified end fitting (FIG. 5).

12. An apparatus as claimed in claim 11, wherein an air-tight bead of sealant (27) is compressed between the housing and the suction plate.

13. An apparatus as claimed in claim 11, wherein the gripping and extracting means are provided on a lower end of the core apron, said apron comprises a plurality of ferrule sections (28) which form internal grips and alternate with sand splines (33), and said ferrules are engaged but not locked on a core center.

14. An apparatus as claimed in claim 13, wherein the ferrule sections are in the form of cylindrical sectors and comprise concave inner surfaces in contact with the core center (17*a*), circular rib sections (29) which protrude from said concave surfaces and engage a continuous circular groove (30) in the core center, convex exterior surfaces flush with the exterior wall of the apron, and raised exterior connector ridges (31).

15. An apparatus as claimed in claim 14, wherein the core center has spaced grooves (32) around its perimeter which are filled with the apron sand splines, each sand splines has a center angle which is at least equal to that of each ferrule section, and each sand spline has gripping ridges (31) of the same shape as those of the ferrule sections.

16. An apparatus as claimed in claim 6, wherein the draw tube is surrounded by a cooling water jacket (8) which, together with a top section of the draw tube, supports the housing.

17. An apparatus as claimed in claim 6, wherein an air-tight tight bead of sealant (6*a*) is compressed between the draw tube and the housing.

* * * * *